US007965220B2

(12) United States Patent
Ganz et al.

(10) Patent No.: US 7,965,220 B2
(45) Date of Patent: Jun. 21, 2011

(54) SMART CHAFF

(75) Inventors: Matthew W. Ganz, Marina del Rey, CA (US); James H. Schaffner, Chatsworth, CA (US); Daniel F. Sievenpiper, Los Angeles, CA (US); Richard P. Berg, Driggs, ID (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 12/418,365

(22) Filed: Apr. 3, 2009

(65) Prior Publication Data

US 2009/0189799 A1 Jul. 30, 2009

Related U.S. Application Data

(62) Division of application No. 11/856,559, filed on Sep. 17, 2007, now Pat. No. 7,533,615.

(51) Int. Cl.
*H01Q 15/20* (2006.01)

(52) U.S. Cl. ..... 342/8; 342/9; 342/6; 342/12

(58) Field of Classification Search ..... 342/12
See application file for complete search history.

(56) References Cited

U.S. PATENT DOCUMENTS

| | | | | | |
|---|---|---|---|---|---|
| 2,472,782 | A | * | 6/1949 | Albersheim | 342/6 |
| 3,276,017 | A | * | 9/1966 | Mullin | 342/8 |
| 3,308,464 | A | * | 3/1967 | Lewis | 342/6 |
| 3,417,398 | A | * | 12/1968 | Lewis et al. | 342/6 |
| 3,623,091 | A | | 11/1971 | Mayo et al. | 342/6 |
| 3,660,843 | A | * | 5/1972 | Wolff | 342/6 |
| 4,028,701 | A | * | 6/1977 | Parks et al. | 342/8 |
| 4,149,304 | A | * | 4/1979 | Brynjegard | 29/895.3 |
| 4,219,819 | A | | 8/1980 | Patel | 342/5 |
| 4,644,864 | A | | 2/1987 | Komorowski et al. | 102/215 |
| 5,369,408 | A | | 11/1994 | Tsui et al. | 342/6 |
| 5,457,472 | A | * | 10/1995 | Bjordal et al. | 343/912 |
| 5,670,959 | A | * | 9/1997 | Nagura et al. | 342/6 |
| 6,017,628 | A | | 1/2000 | Stevens et al. | 428/381 |
| 6,429,800 | B1 | | 8/2002 | Richmond | 342/14 |
| 6,456,225 | B1 | | 9/2002 | Forster et al. | 342/12 |
| 6,507,307 | B1 | * | 1/2003 | Huber, Jr. | 342/9 |
| 6,513,438 | B1 | | 2/2003 | Fegg et al. | 102/336 |
| 6,559,790 | B1 | * | 5/2003 | Buehler et al. | 342/6 |
| 6,628,239 | B1 | | 9/2003 | Hilliard et al. | 343/850 |
| 7,400,287 | B2 | | 7/2008 | Saccomanno | 342/12 |
| 2008/0143579 | A1 | | 6/2008 | Saccomanno | 342/12 |

FOREIGN PATENT DOCUMENTS

| | | |
|---|---|---|
| GB | 2082862 | 3/1982 |
| JP | 09210597 A | 8/1997 |

* cited by examiner

*Primary Examiner* — Thomas G Black
*Assistant Examiner* — Shelley Chen
(74) *Attorney, Agent, or Firm* — Ladas & Parry

(57) ABSTRACT

A chaff element for interfering with radar signals. The chaff element has a dielectric substrate and a pair of elongate electrically conductive elements, having a total length of approximately one-half wavelength of the radar signals or otherwise tuned to the radar signals, disposed on the dielectric substrate. A switch is arranged to electrically couple the pair of elongate elements together in response to a control signal generated by an oscillator circuit and a battery. The chaff element can be used in a method of providing a countermeasure against radar signals. A plurality of chaff elements can be deployed in an airspace above a radar unit emitting a radar signal and interfere with the radar signal by opening and closing the switches of the chaff elements while deployed in said airspace above the radar unit.

13 Claims, 9 Drawing Sheets

Add time gating to trick Kalman track filters:

- Deterministic sequential gating based upon deployment time
- Add a mother ship to tell chaff when to turn off and on:
- Self synchronization via neighbor-to-neighbor communication and stochastic resonance

SMART CHAFF

TECHNICAL FIELD

This disclosure relates to chaff and to tags that can be cast free in the air for the purpose of providing information. Chaff can be used as a radar countermeasure. Tags can be used to convey information when illuminated by electromagnetic waves. The chaff disclosed herein is active in that its radio frequency wave reflective properties can be varied in order to better protect an airplane from being successfully acquired by radar.

BACKGROUND

A classic radar countermeasure is the use of chaff. Chaff is employed by distributing thousands to millions of small metal dipoles in the volume being searched by the victim radar. Prior art chaff may be made of a light-weight, electrically conductive material, and may assume the form of stripes of aluminum foil. The large radar cross section produced by the chaff cloud is intended to mask real radar targets (e.g., aircraft) that might be flying in or near the cloud. FIG. 1 shows a ground based radar system 10 that is searching for a jet aircraft 12. The chaff 14, consisting of thousands to millions of dipoles, preferably having a length equal to a half wavelength at the radar frequency, are scattered in the atmosphere and flutter very slowly to earth (on the order of ten hours) due to its light weight. The jet aircraft 12 flies above the cloud of chaff 14 in order to mask its presence from radar beam 11. As shown in FIG. 1, as the radar beam 11 sweeps past this cloud of chaff 14 a very strong reflected signal 13 comes from the multitude of dipoles, as well as reflections from the jet 12 due to leakage of the radar beam through the chaff 14.

As shown by FIG. 2*a*, the signal return from the jet 12 is shifted by the Doppler frequency given by $$f_d = 2\frac{v}{c} f_r \cos\theta$$

where v is the speed of the jet, c is the speed of light, $f_r$ is the radar frequency, and θ is the elevation angle from the radar to the jet. For example, for a jet moving at 1,320 mph (Mach 2 at 40,000 feet), the maximum Doppler frequency at the horizon, θ=0° for a 500 MHz radar is about 1 kHz.

Radar designers try to defeat chaff by using multi-pulse coherent waveforms. See FIGS. 2*a*, 2*b* and 2*c*. The return signals can be Doppler processed (i.e., Fourier transformed into the frequency domain—see FIG. 3) to separate target signals 16, 18 with various Doppler shifts using filters 10- and 10-2. A moving radar target (e.g., jet 14) will have a larger Doppler shift (see spike 18) than the chaff cloud (which drifts at the ambient wind velocity—see chaff spectrum 16). The coherent radar can thus separate the target from the chaff based upon this Doppler shift.

If the radar has Doppler and tracking filtering, as shown in FIGS. 2*b* and 2*c*, then the chaff response can be notch filtered (see the filter's characteristic 20), thus bringing the jet's return signal 18 above detection threshold 22 (see FIG. 2*c*).

The response of the chaff-deploying entity in response to coherent radar processing is to lay more chaff. By dropping an extraordinary amount of chaff, one might hope to either overwhelm the dynamic range of the radar receiver or provide a strong enough zero-Doppler chaff return that significant energy leaks into the higher Doppler bins and competes with the target. This is an inherently inefficient technique as typical Doppler filters may have sidelobes well in excess of −50 dB. Thus, a massive amount of chaff would be needed to reduce the jet's response below the threshold value.

The prior art includes a disclosure by D. P. Hillard, G. E. Hillard, and M. P. Hillard, "Variable Scattering Device," U.S. Pat. No. 6,628,239, Sep. 30, 2003 and military research programs such as the DARPA Digital RF Tags (DRAFT) program that built active electronic devices that transmitted signals back to interrogating radar systems. The DRAFT tags have a size, weight, cost and power consumption that would make them unreasonable for use in large numbers in an expendable application.

BRIEF DESCRIPTION

A chaff element for interfering with a radar installation, when the chaff element deployed in airspace, is disclosed. The chaff element includes a dielectric substrate with a pair of elongate electrically conductive elements disposed on said dielectric surface, the pair of elongate electrically conductive elements having a total length of approximately one-half wavelength for a radio frequency associated with the radar installation. A switch is arranged to electrically couple the pair of elongate electrically conductive elements together. The switch opens and closes in response to a control signal. The switch is mounted on the dielectric substrate and adjacent said pair of elongate electrically conductive elements. An oscillator circuit for generating the control signal is also mounted on the dielectric substrate with a battery for energizing the oscillator circuit, the battery also being mounted on the dielectric substrate.

DETAILED DESCRIPTION OF THE PREFERRED EMBODIMENTS OF THE DISCLOSED TECHNOLOGY

The present invention preferably utilizes a chaff dipole that comprises two quarter-wavelength portions. In the center of the two quarter-wavelength portions is placed an electronic (or MEMS) switch that opens and closes at a frequency corresponding to a real target's Doppler shift. The closing of the switch couples to two portions together to form a single one-wavelength dipole. When a radar beam illuminates a cloud of these smart chaff dipoles, the radar reflection is returned to the radar modulated in such a way that it passes through the Doppler filtering. This gives this smart chaff a processing advantage of 10's of dB over conventional chaff. With smart chaff, potentially orders of magnitude fewer elements need to be deployed to have the same effect. Furthermore, with the introduction of minimal automatic intelligence or signal processing, smart chaff can become a very low-cost yet sophisticated radar jammer.

Each smart chaff element comprises a split radiating element (a thin electrically conductive wire or ribbon), a switch that opens and closes to connect/disconnect the two elements, and an electronic oscillator that drives the switch, and a small battery or photovoltaic cell to power the system.

By moving the Doppler frequency of a chaff element into the coherent radar's passband, the effectiveness of the smart chaff element becomes orders of magnitude greater than that of a passive chaff element. If smart chaff elements can be made cheaply, they may become a very cost effective and useful alternative to either chaff or active jamming.

Figure 4A:
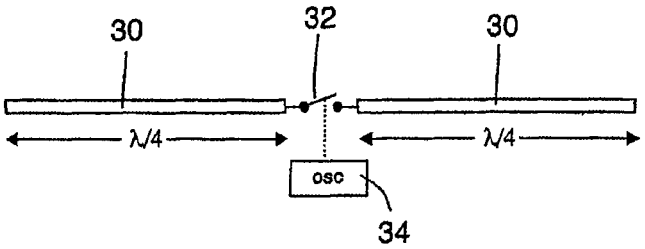
FIG. 4*a* is a schematic diagram of an embodiment of a smart chaff element.
Figure 4B:
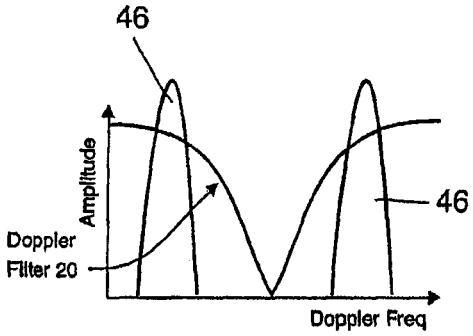
FIGS. 4*b* and 4*c* are graphs showing the Doppler shift and the residual clutter effects of smart chaff.
Figure 4C:
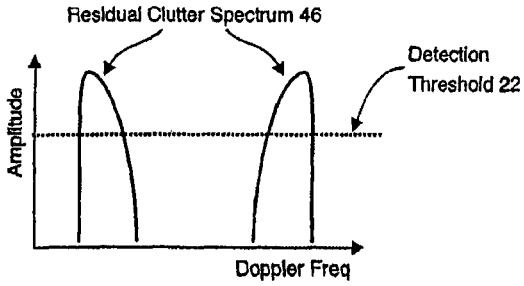

Smart chaff also could be used as a passive readout mechanism for sensors that could be interrogated by a radar signal. For example, such a sensor might measure an analog quantity (such as temperature) and then modulate its switch at a rate proportional to this analog measurement. A radar passing overhead could then send pulses toward the sensor and could detect the modulated return signal and read out the analog signal in the process. As the smart chaff element (or tag in this case) is not radiating any energy it would be undetectable to a conventional radio receiver in the absence of the interrogating radar FIG. 4*a* shows the important components of a single smart chaff element 28, which has a $\lambda/2$ dipole that is split into two $\lambda/4$ sections 30. An analog switch 32, electronic or RF MEMS, is attached in series between these two sections 30. The switch 32 is actuated at a rate near the Doppler frequency of jet 12; the switching rate of switch 32 is controlled by an oscillator 34. When the switch 32 is closed, the dipole is resonant and reflects part of the radar beam (depending on the radar cross section of the dipole); when the switch is open the dipole is not resonant, and very little of the radar beam is reflected (due to a very small radar cross section). Thus, the signal reflected back to the radar unit 10 is the radar carrier wave amplitude modulated by a square wave. The Fourier spectral response of the return signal from the dipole has a strong component at the carrier plus modulation frequency (plus harmonics), which can be made to occur close to the Doppler frequency of jet 12, as shown in FIG. 4*b*. This spectrum now has components 46 that are out of the Doppler filter (see numeral 20) and can fool the radar into thinking that there is a dipole moving near the speed of the jet.

Figure 5:
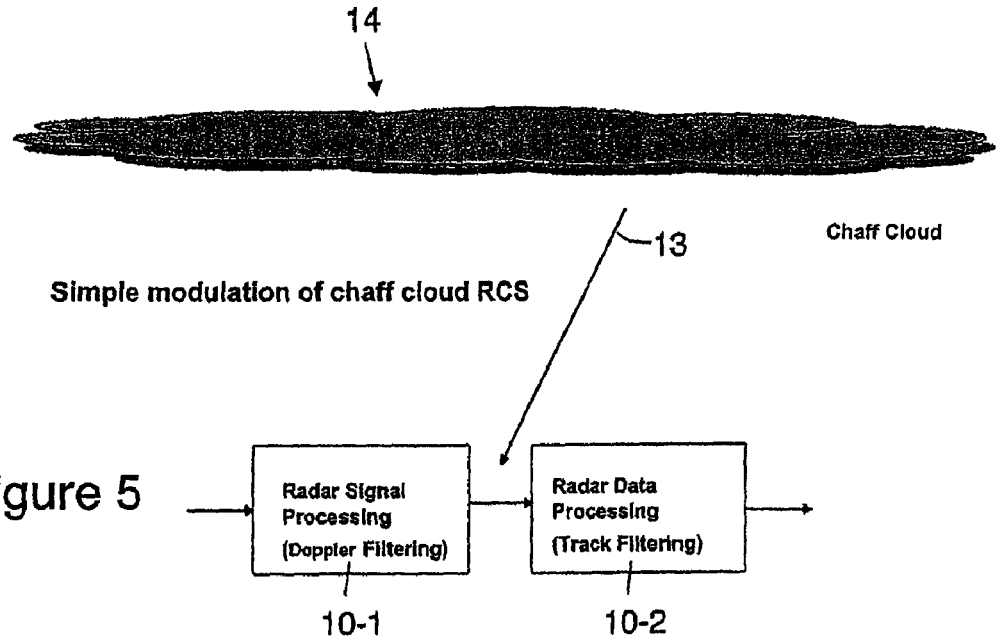
FIG. 5 demonstrates how a Doppler filter used in conventional radar systems is fooled into "thinking" that return for a chaff cloud formed by smart chaff elements is moving at a high rate of speed similar to that of the aircraft that the radar installation is trying to detect.
Figure 6:
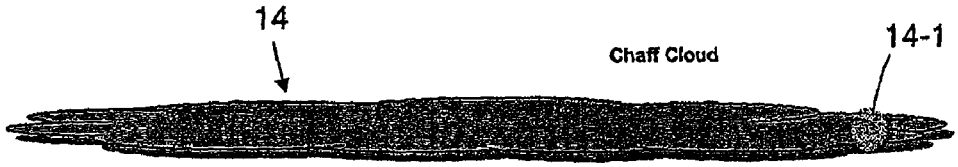
FIGS. 6 and 6*a* demonstrate the effect and technique of time gating of the smart chaff to fool the radar track filtering used in conventional radar installations.
Figure 6:
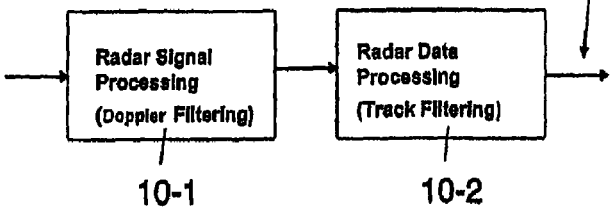
Figure 6A:
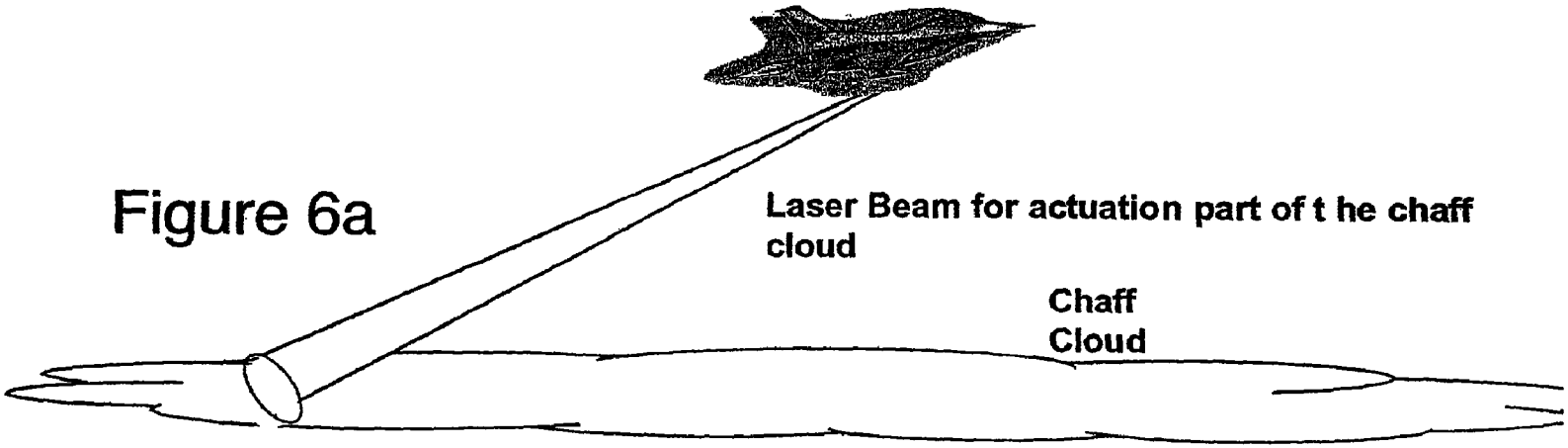
Figure 6B:
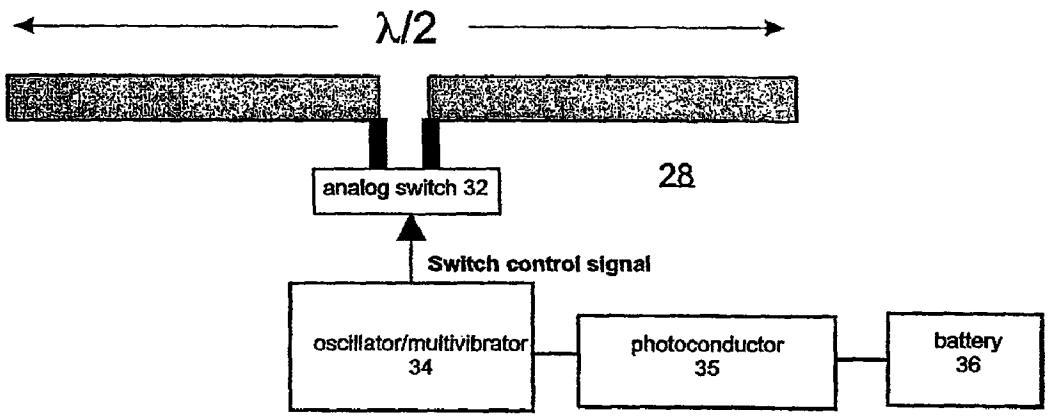
FIG. 6*b* is a schematic diagram of an embodiment of a smart chaff element for use with the time gating technique described with reference to FIGS. 6 and 6*a*.

In the simplest scenario, shown in FIG. 5, if the whole cloud of chaff 14 is modulated, then the return signal 13 to the radar 10 (represented here by two filter blocks 10-1 and 10-2 commonly used in radar processing) will fool it into "thinking" that the whole cloud is moving at an effective Doppler speed given by the frequency of the modulation. This should confuse the radar's Doppler filters 10-1 and 10-2 enough to allow the jet's real location to remain undetected. More sophistication can be added to also fool the tracking filters to, for instance, simulate a flight path of a fictitious aircraft. This can be accomplished by adding time gating to the smart chaff, as shown in FIGS. 6, 6*a* and 6*b*. By further adding complex timing, the flight paths of multiple fictitious aircraft can be simulated (see FIG. 7).

Figure 1:
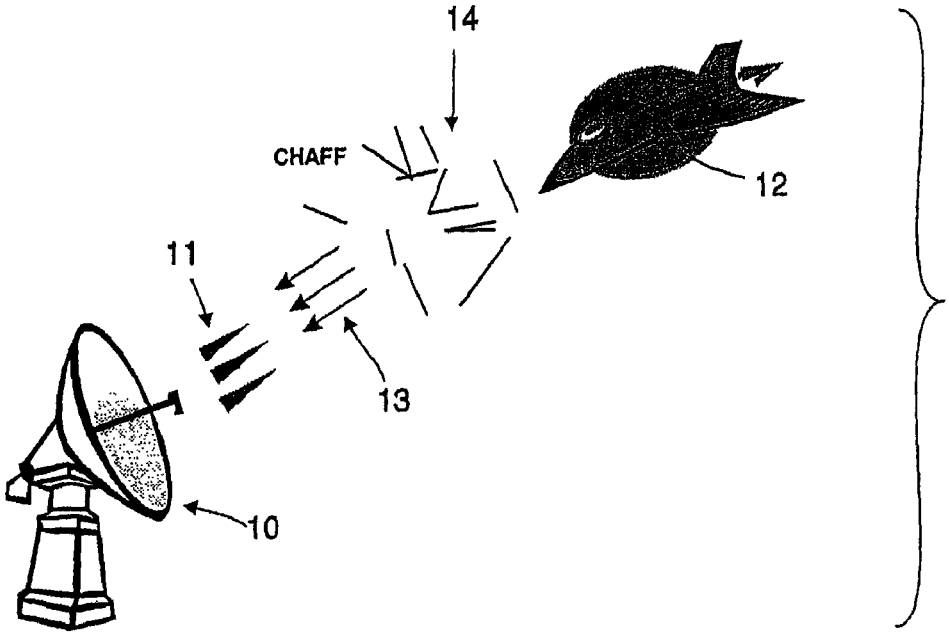
FIG. 1 depicts a radar installation that emits radio frequency waves seeking to locate an aircraft in the airspace adjacent the radar installation and chaff is depicted, the chaff being intended to interfere with the radar installation's detection of the aircraft.
Figure 2A:
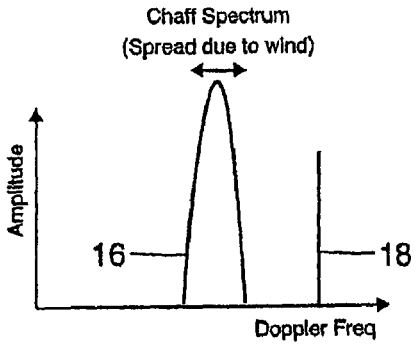
FIGS. 2*a*, 2*b* and 2*c* are graphs for the Doppler shift associated with the chaff and the aircraft, together with the effect of radar signal processing.
Figure 2B:
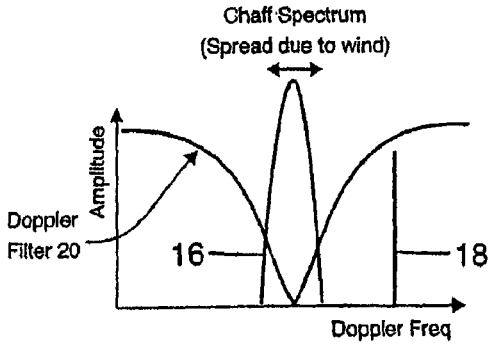
Figure 2C:
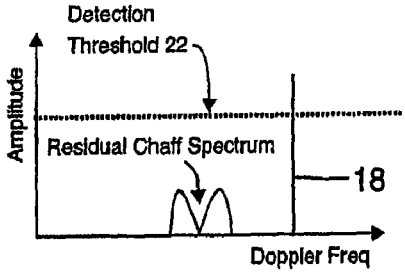
Figure 3:
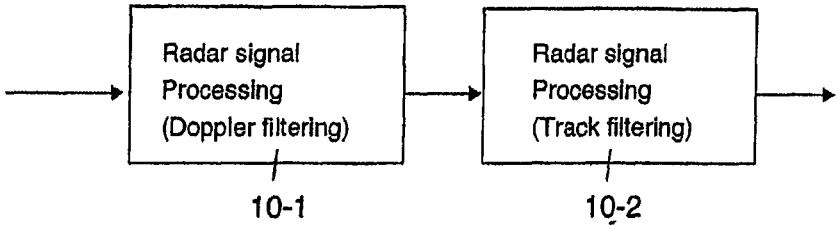
FIG. 3 shows a conventional signal processing used in a radar installation.
Figure 7:
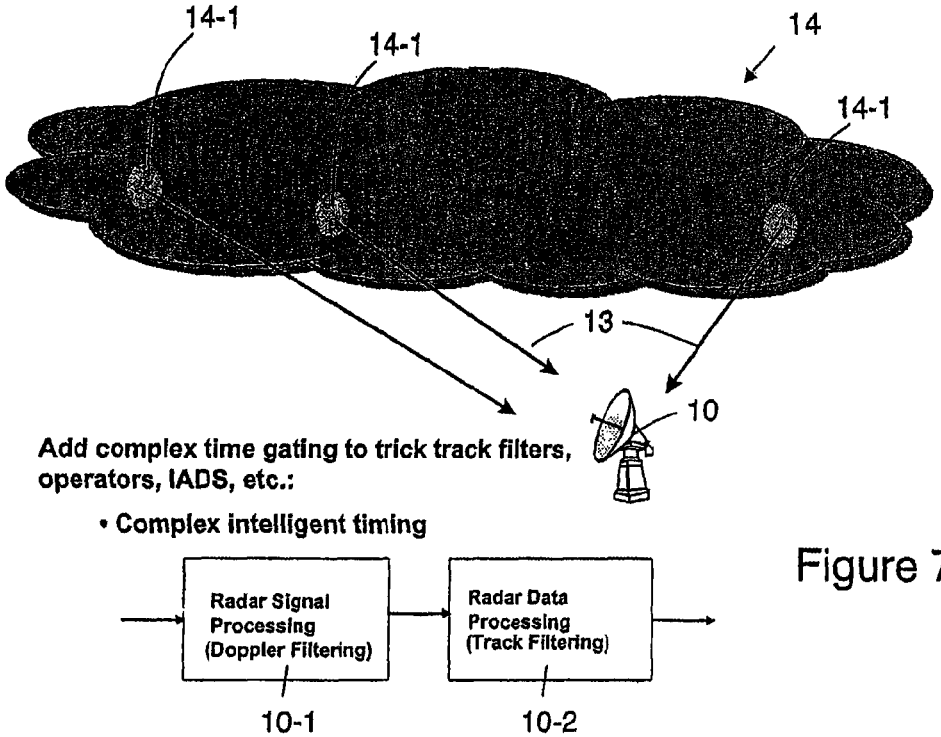
FIG. 7 demonstrates the effect of complex time gating of the smart chaff to fool the radar track filtering used in conventional radar installations even further.

In FIG. 6, only a small portion (a "spot") 14-1 of the chaff cloud is triggered to provide a response 13 to the radar 10 (again represented here by two filter blocks 10-1 and 10-2 commonly used in radar processing). This spot is moved to simulate a phantom aircraft. In FIGS. 6*a* and 6*b*, one technique for time gating chaff elements 28 is shown. Each chaff element 28 (see FIG. 6*b*) in this embodiment preferably has a photoconductive switch 35 that is located between a battery 36 (or other source of electrical energy) and the modulator or oscillator 34. After the chaff cloud 14 (see FIG. 6*a*) is deployed a laser beam 40 is used to create charges in the photoconductor 35 and thus electrically connect the battery 36 to the modulator 34. Only those chaff elements 28 in the chaff cloud 14 that are within the laser beam get actuated. They form the spot 14-1. The laser transmitter would be located in an aircraft 42 flying above the chaff cloud 14, and in fact it could be the same aircraft that deploys the chaff cloud. When the laser beam 40 is scanned over a prescribed course, the ground radar unit 10 (FIG. 1) would be fooled into tracking a "ghost" jet aircraft. Multiple laser beams 40 could also be used to simulate more than one fictitious aircraft by forming multiple moving spots 14-1, as shown by FIG. 7.

A second method of time gating is to turn on each chaff's switch at a time based upon the time that chaff element was deployed. For example, a timer could be added to each chaff switch control oscillator such that the first group of chaff elements do not turn on (actuate) until a fixed time T after deployment. Then as further groups of chaff elements are deployed, the timers in each group of chaff elements are set to turn on (actuate) their respective oscillators at a time of T−t after deployment, where t equals the time of deployment after the first group of chaff elements were deployed. The timers each cause their respective oscillators to run for a time $t_r$, whereupon their turn off (at least temporarily). In this example, the radar would be tricked into assuming that there was a target moving in a direction opposite to the vector of chaff deployment.

A third technique to time the gating is to have selected chaff dipoles contain an active RF source (not necessarily at the radar's RF frequency) and the other chaff dipoles containing RF receivers responsive to the chaff-based RF source(s). At a time T the active chaff RF source turns on for a time $\Delta T$. This triggers (or actuates) the other nearby chaff (close enough to receive the signal) to turn on their oscillators. Thus, self-synchronization of the chaff elements would be localized around an active chaff element. In this way a radar pattern of pseudo-Doppler scattering can be enabled by appropriate deployment of these active chaff elements.

Figure 8:
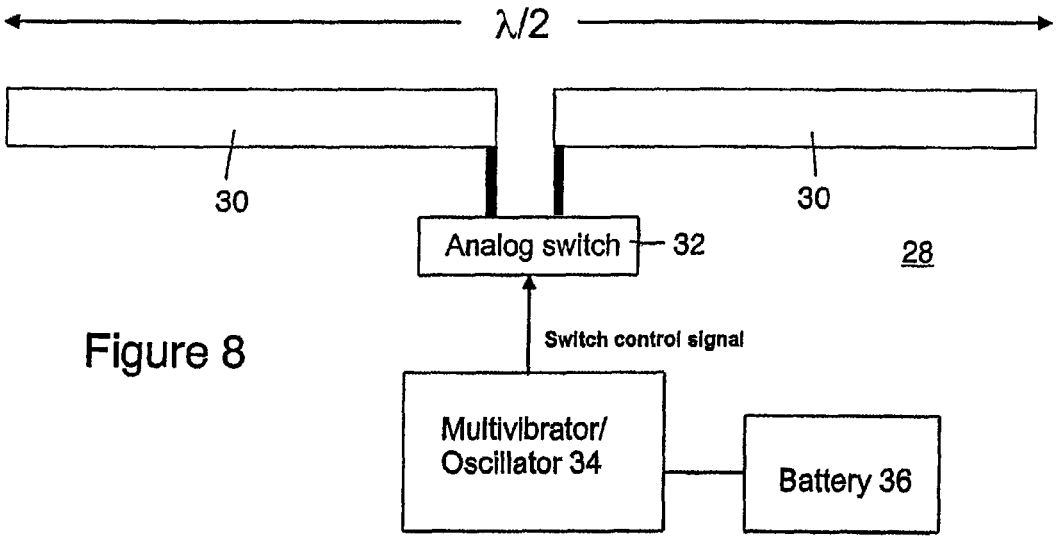
FIG. 8 depicts another embodiment of a smart chaff element.
Figure 9A:
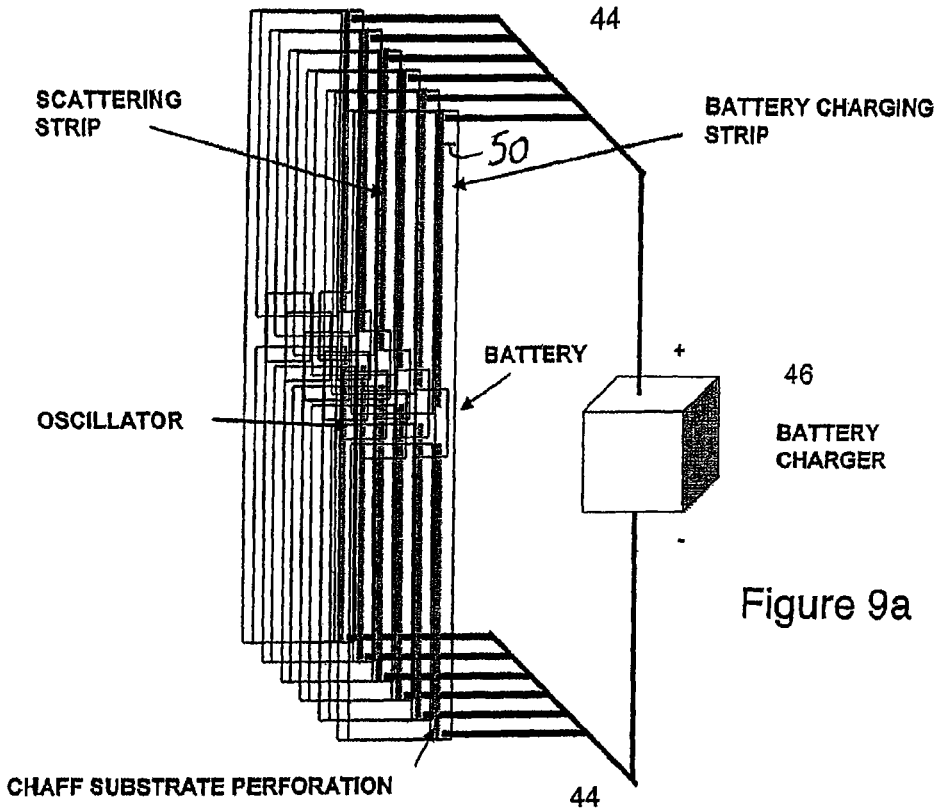
FIGS. 9*a* and 9*b* depict one arrangement for charging the battery on a smart chaff element.
Figure 9B:
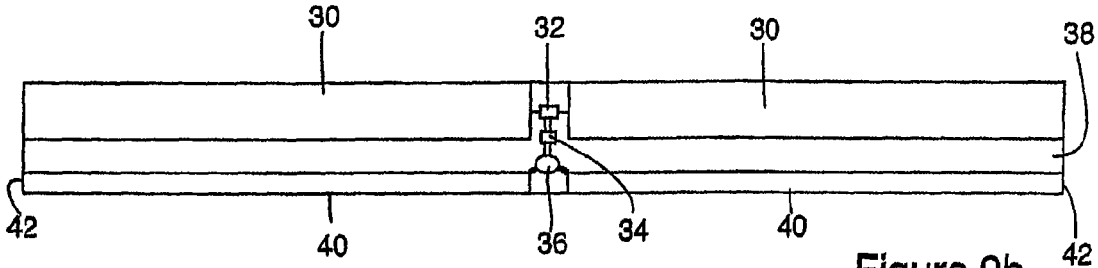

Another embodiment of the smart chaff dipole 28 is shown in FIG. 8. A multivibrator or other oscillator 34 is used to actuate an analog switch 32, such as a FET switch or a MEMS switch. A small battery (or other source of electrical energy) 36 provides power to the multivibrator 34 and switch 32. Obviously, the weight (mass) of these circuits 32, 34, 36 should be maintained as low as reasonably possible to maintain a slow downward drift of the chaff elements 28 making up a chaff cloud 14. As such, these circuits are preferably allowed to remain relatively simple forms. The basic multivibrator circuit 34 only need have a few transistors, capacitors, and resistors, as is known by those skilled in the art. Technology to embed MMIC circuits in polyimide substrates is also available in the prior art to create very lightweight circuits that may be embedded in the chaff strips. These can be easily assembled using known flex circuit assembly technologies, such as pick-and-place. FIG. 9*b* shows an embodiment of the foregoing elements disposed on a plastic (preferably polymide) substrate 38.

The dynamic power expended driving a capacitive load by a switching transistor, such as a MOSFET gate, is given by $$P=fCV_s^2$$

where C is the capacitor being charged, $V_s$ is the charging voltage, and f is the frequency of charging the capacitor. The simplest astable multivibrators use only two transistors which are switched from cut-off to saturation. If we assume that such a multivibrator 34 drives an analog MOSFET switch 32 to turn the chaff dipole 28 on/off, then all of the transistor loads are gate capacitors. Typical gate capacitances for MOSFET transistors are a few pF at most. If we assume that the switching voltage for the capacitors is 5 V, and that they are switched at a 1 kHz rate, then the power expended per transistor is 50 nW. For three transistors (two in the multivibrator and one RF switch) the power expended in switching is on the order of 150 nW. Recent battery technology developments have resulted in lithium batteries 2.0 μm thick that provide 3.6 V with a capacity of 9.2 $\mu A\ h\ cm^{-2}$, which will provide about 33 $\mu W\ h\ cm^{-2}$, or 330 $nW\ h\ mm^{-2}$. If it is assumed that the smart chaff 28 active circuits draw 0.5 mW (more than triple the transistor charging to account for other losses), then two of these batteries such be connected in series, each having an area about 2 $mm^2$ and together providing about an hour of power. Thus the battery volume is on the order of 0.0004 $mm^3$. This is tiny.

Three different techniques for actuating the smart chaff 28 will now be described. It is assumed that the smart chaff 28 could remain in storage for many years and then be deployed in a national emergency. Thus, it is not likely that battery 36 will remain charged for that length of time. To actuate the smart chaff circuitry, the battery 36 that is used to power each chaff dipole must be charged up and connected into the circuit either right before deployment and shortly after deployment.

A first method is now described with reference to FIGS. 9*a* and 9*b*. Each arm 30 of the chaff dipole has a very narrow metallic strip 40 running alongside the relatively wider dipole metallic strip 30. The strips 40 are electrically isolated from the dipole strips 30 at DC and they are so narrow that they do not interfere with the RF performance of the chaff dipole 28. The ends 42 of the narrow strips 40 are attached to wires 44 which in turn are connected to a battery charging unit 47 for charging the batteries 36 of many, many smart chaff dipoles 28 preferably immediately before deployment. The current to charge each chaff battery 36 is routed to each chaff dipole through a parallel array of wires 46, as shown in FIG. 9*a*. The physical connection of the wires 44 to the ends 42 of each chaff dipole 28 are physically weak so that as the chaff is deployed (after the batteries 36 have been charged), the charging wires 44 are pulled away from (and released from) the chaff dipole elements 28. One method of physically separating the wires that are soldered or otherwise connected to the thin strips 40 alongside the chaff dipole segments 30 is to perforate the dipole plastic substrate 38 with small holes 50 (similar to an old fashioned postage stamp) so that the charging connection to the smart chaff 28 is easily ripped away as the chaff 28 is deployed.

Figure 10:
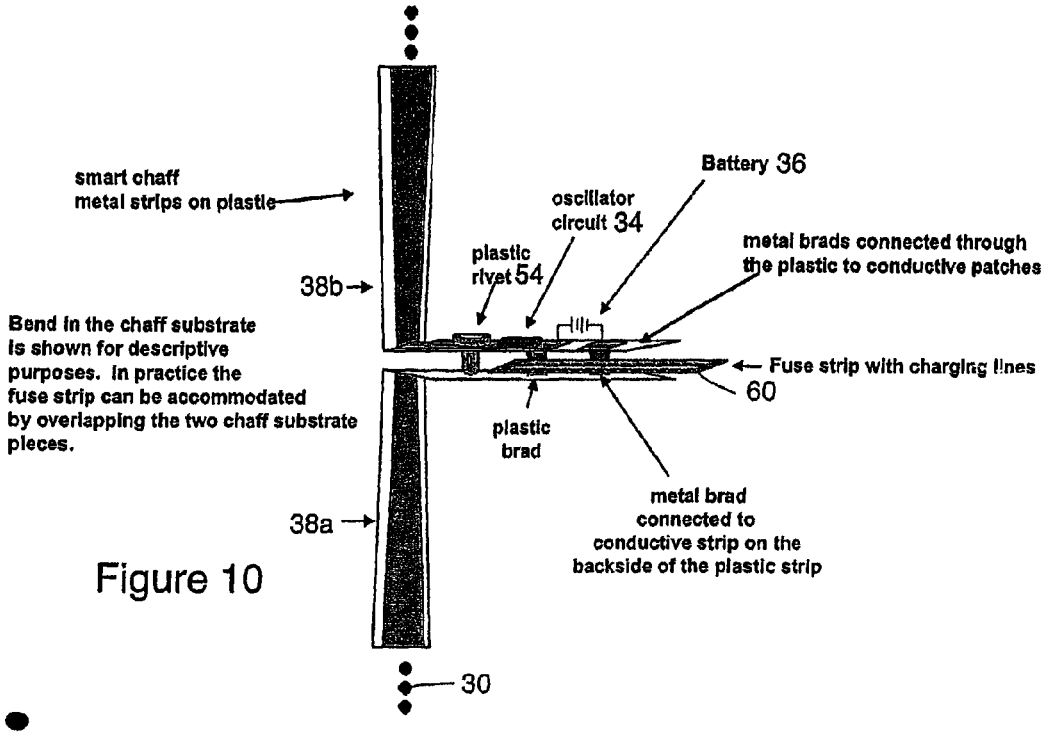
FIGS. 10, 10*a* and 10*b* depict another embodiment of smart chaff showing another technique for charging the battery associated therewith.
Figure 10B:
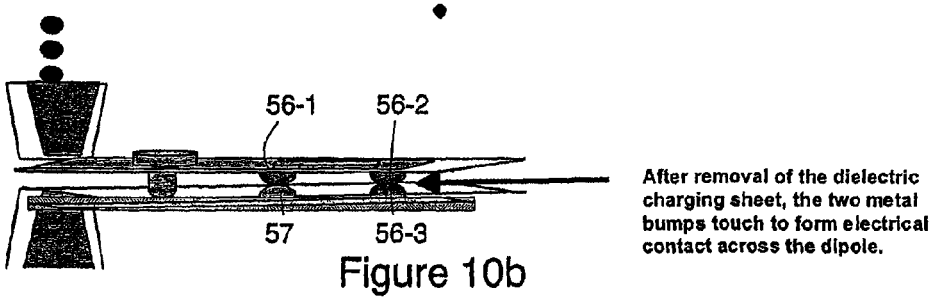

Another embodiment for actuating the smart chaff uses an insulating strip 60, as shown in FIG. 10. In this embodiment the arms 30 of the chaff dipole 28 are fabricated on two separate plastic substrates 38*a* and 38*b*. These substrates 38*a*, 38*b* are preferably bent into an L shaped configuration and are connected together preferably with one or more small plastic rivets 54, to form a complete chaff dipole unit 28. As shown in FIG. 10*b*, there are three metal bumps 56 (individually identified as 56-1, 56-2 and 56-3) and one plastic bump 57 that are located beyond the rivet 54 along short lengths 38*a*-1 and 18*b*-1 of the chaff plastic substrates 38*a*, 38*b*. These bumps physically separate the chaff substrate ends while elastic forces in the plastic keep opposing bumps touching. The two metal bumps 56-1 and 56-2 on one side of chaff substrate 38*b*-1 are electrically connected through the plastic substrate to conductive patches 58 on the opposite side of the substrate 38*b* to which the battery 36 poles are connected. One end of the oscillator circuit 34 output is connected to the upper arm 38*b* of the chaff dipole. The lower metal bump 56-3 is electrically connected to the lower arm 38*a* of the chaff dipole through the plastic substrate 38*a*-1. The purpose of the plastic bump 57 is to insure that a conductor 62 an insulating sheet 64 temporarily disposed between the chaff arms makes good physical contact to the metal bump 56-1.

During storage, the dielectric sheet 60, which may be made of paper and/or plastic, for example, keeps the opposing bumps 56-2 and 56-3 from touching. On one side of the dielectric sheet 60 are deposited two parallel conduction strips 62 that, in use, are connected to a battery charging unit 46 in a similar manner to that shown in FIG. 9*a*. Each conduction strip 62 contacts a metal bump 56-1, 56-2 on the upper chaff substrate 38*b*-1 and is thus electrically connected to the battery 36 for charging it. It is through these metal bumps that the battery 36 is charged just before deployment of the chaff element 28. When the chaff element 28 is deployed, the insulating sheet 60 is pulled from between the chaff substrates 38*a*-1, 38*b*-1. Elastic force pushes the bumps together. The opposing metal bumps 56-2, 56-3 now touch and thus connect the oscillator circuit (preferably arranged in series with the battery 36) across both arms of the dipole. The remaining metal brad 56-1 that was used to charge the battery now touches the plastic brad 57 and is thus effectively removed from the circuit. Although the chaff substrate is shown bent in FIG. 10, it need not be and the dielectric sheet 60 can be placed in between two parallel chaff substrates.

In the embodiments of FIGS. 9*a* and 9*b*, the smart chaff 28 commences operation once it is disconnected from the source of power 46. Given the fact that battery 36 is small and lightweight, it can only power the circuits of the smart chaff 28 for a matter of hours. This implies that the source of power 46 is located onboard the aircraft that deploys the smart chaff 28 in that embodiment, which in turn suggests that the aircraft deploying the smart chaff is especially outfitted for this purpose. That may prove to be inconvenient.

Figure 10A:
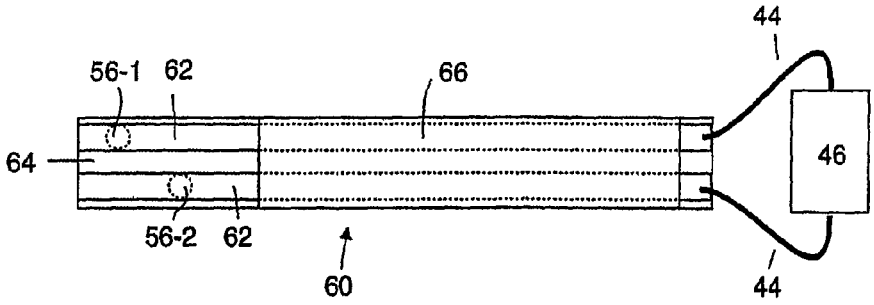

In the case of the embodiment of FIGS. 10, 10*a*, 10*b*, the source of power 46 can be located aboard the aircraft or off aircraft, as desired. If off aircraft, the batteries 36 would be charged and then the smart chaff 28 would be loaded onto the aircraft with dielectric sheets 60 in place between chaff substrates 38*a* and 18*b*, thereby effectively causing the circuits on the smart chaff 28 to assume an off state when placed onboard the deploying aircraft. The dielectric sheets 60 would be removed shortly before or as the smart chaff 28 exits the deploying aircraft, thereby causing the smart chaff 28 to start operation as previously described.

Figure 11A:
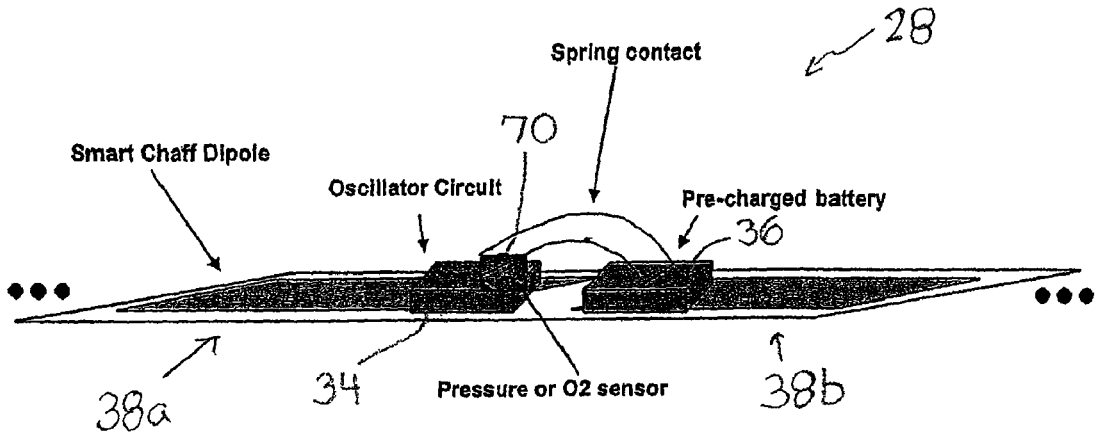
FIGS. 11*a* and 11*b* show additional embodiments of a smart chaff element which include a switch for selectively energizing the oscillator.
Figure 11B:
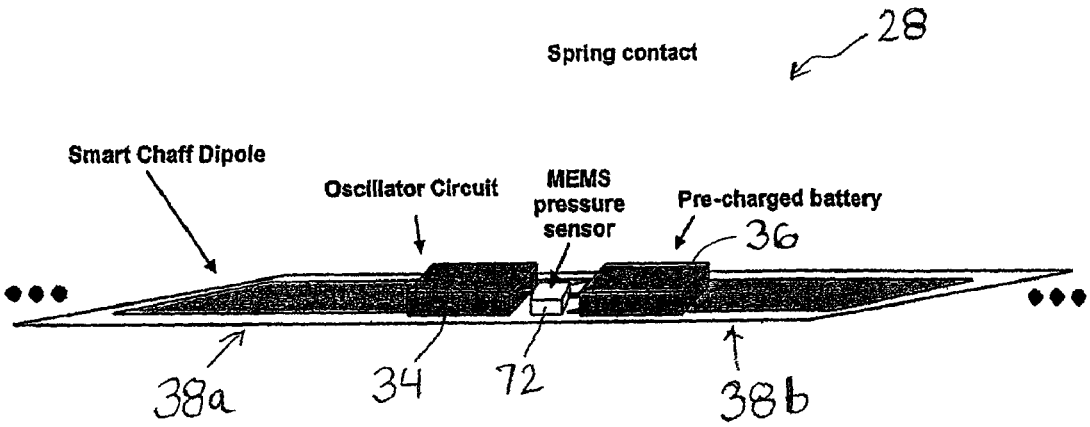

Additional embodiments are now described with reference to FIGS. 11*a* and 11*b* wherein the smart chaff 28 may be coupled to source of power 46 for charging batteries 36 before being loaded onto the aircraft which will deploy the chaff 28. This, of course, simplifies the configuration of the aircraft since it need not be equipped with charging equipment. In this embodiment, battery 36 is charged by a method such as shown in FIG. 9*a* or 10, for example. In this embodiment, after battery 36 is charged, the battery 36 is connected to the oscillator after the chaff 28 is deployed. FIGS. 11*a* and 11*b* shows how the battery 36 can be connected to the oscillator 34 of the smart chaff 28 by sensing the environment outside the deploying aircraft after deployment. This can be done by integrating a small pressure sensor 70, such as an air bubble in a flexible membrane which expands when the chaff is deployed high in the atmosphere, or by a sensor that detects oxygen in the atmosphere (assuming that the chaff is stored in a nearly pure nitrogen environment, for example) or by sensing another environmental factor, such as temperature, which triggers a switch connecting the battery 36 with the oscillator 34, as shown by FIG. 11*a*, when the chaff elements 28 are deployed. Alternatively, pressure sensor 70 can be implemented as a pressure sensitive MEMS switch 72, as shown in the embodiment of FIG. 11*b*. The sensor 70 or 72 is arranged to close at altitudes or environments where the chaff is effective and arranged to open at altitudes or environments where the chaff is normally stored or charged.

The smart chaff element 28 disclosed herein may be further modified, for example, as follows:

1) The sections 30 instead of each being $\lambda/4$ long may instead be asymmetric (one where elements 30 are not split equidistantly in the middle, but instead at another point). This should broaden the frequency bands to which the smart chaff 28 is effective.

2) The smart chaff element 28 may be supplied with additional circuitry to allow the oscillations to be turned on or off by an external stimuli such as an intelligent RF signal or a laser beam. Such a system might be effective in creating one or more specific radar targets in order to fool not only the victim radar's Doppler filtering, but its target track (e.g., Kalman) filtering as well.

3) The antenna of the smart chaff element 28, instead of being a dipole, may be a corner reflector built with oscillating switches among certain surfaces to modulate the reflection from this smart chaff unit. Such an embodiment might be more cost effective than a dipole-type smart chaff for higher frequency (e.g., microwave) applications.

4) The smart chaff may include either passive apparatus (e.g., a parachute or helium balloon) or active apparatus (a propulsion system) in order to enhance the hang-time of the smart chaff system.

Figure 12:
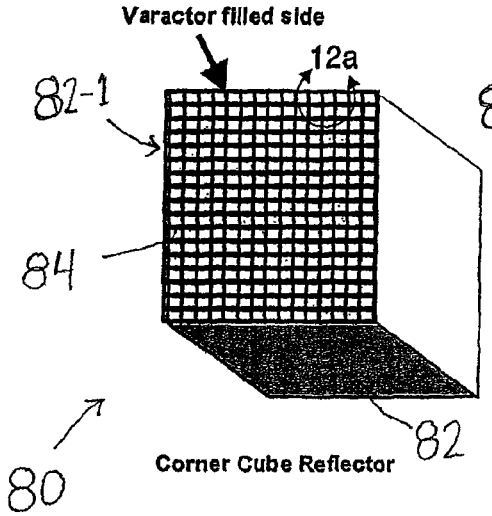
FIGS. 12 and 12*a* show an alternative embodiment of a switched dipole smart chaff element in the form of a corner cube reflector.
Figure 12A:
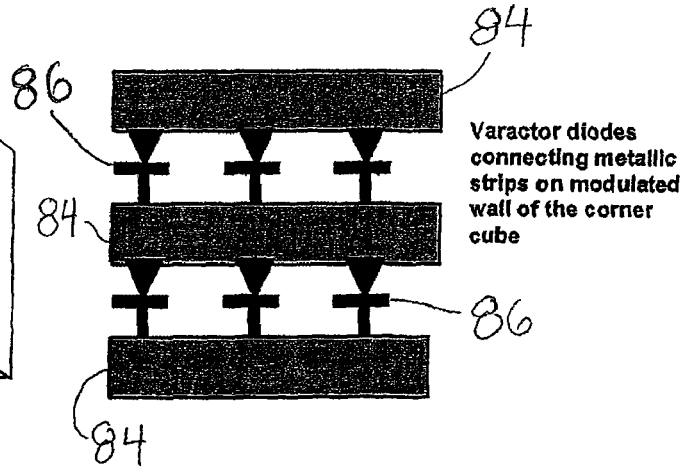

An alternative embodiment to the switched dipole smart chaff element is a corner cube reflector 80 with one wall that has a modulated impedance. See FIGS. 12 and 12*a*. In general, a corner cube reflector has three metallic sides 82 that provide the property of reflecting an incident electromagnetic wave in the direction exactly 180° from the incident direction. By modulating the impedance of one wall 82-1 of the corner reflector 80, the returned electromagnetic wave will have a modulated waveform, and hence, additional frequency components which can be made to have significant amplitude at the desired Doppler frequency.

The impedance of the modulation wall 82-1 can be made to vary by creating the wall with strips of metal 84 that are interconnected with rows of varactor diodes 86. These diodes 86 are preferably operated in the reverse bias mode and thus draw very little current. A single voltage can be impressed across the face of this side of the corner reflector such that each row 90 of diodes 86 is reverse biased with the same voltage. Then by modulating this voltage, the capacitance of the varactor diodes 86 will follow the modulating waveform which, in turn, effectively modulates the impedance of this surface 82-1.

The corner cube reflector can be stored in a flat L-shaped configuration and then allowed to assume a typical corner cube configuration upon or shortly after release. The orientation and fall rate of the corner cube can be controlled by a small parachute.

The foregoing Detailed Description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for one or more particular use(s) or implementation(s). The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. The applicants have made this disclosure with respect to the current state of the art, but also contemplate advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising the step(s) of . . . ."

The invention claimed is:

1. A chaff element for interfering with radar signals when the chaff element is deployed in an airspace, the chaff element comprising:

three walls having inside surfaces meeting at substantially right angles, two of said walls having metallic inside surfaces and one of said walls formed of a plurality of metallic strips and a plurality of rows of modulating switches adapted to modulate the reflection of an incident electromagnetic wave, each row of said modulating switches interconnected between two of said metallic strips;

a control switch arranged to modulate voltage to the modulating switches, the switch being responsive to a control signal; and a circuit for generating said control signal;

wherein the three walls are configured to allow storage in a flat configuration.

2. The chaff element of clam 1 further comprising:

a power source for energizing the circuit.

3. The chaff element of claim 1 wherein the inside surfaces of the walls are metallic.

4. The chaff element of claim 1 wherein the modulating switches are diodes.

5. The chaff element of claim 1 wherein the modulating switches are rows of varactor diodes.

6. The chaff element of claim 5 wherein the rows of varactor diodes interconnect the plurality of metallic strips.

7. The chaff element of claim 6 wherein each row of diodes is reverse biased with the same voltage whereby the modulation of the voltage causes the capacitance of the diodes to follow the modulation of the voltage and thence to modulate the impedance of the inside surface of the one of the walls.

8. The chaff element of claim 1 wherein the three walls can be stored in a flat L-shaped configuration and allowed to assume a configuration in which the inside surfaces meet at substantially right angles upon or shortly after release.

9. The chaff element of clam 1, wherein the chaff element is a corner cube reflector.

10. The chaff element of clam 1, wherein said metallic strips are substantially planar.

11. The chaff element of claim 1 further comprising a parachute or a propulsion system to control the orientation and fall rate of the chaff element.

12. The chaff element of claim 1 wherein the plurality of metallic strips are arranged in rows interconnected by the modulating switches.

13. A system for charging batteries associated with chaff elements while on board deployment aircraft, the chaff elements including the chaff element of claim 1, and the system comprising:

a power supply coupled to charging lines disposed on a plurality of flexible insulating strips;

a receptacle associated with each chaff element for receiving one of the flexible insulating strips, the receptacle being configured to couple the battery of chaff element with the charging lines on the insulating strip when the insulating strip is received therein for the purposes of (i) charging the battery and (ii) isolating the battery from other active elements associated with the chaff element, the receptacle being further configured to couple the battery with at least one other active element on the chaff element in response to removal of the insulating strip from said receptacle.

* * * * *